US006547602B2

(12) United States Patent
Price et al.

(10) Patent No.: US 6,547,602 B2
(45) Date of Patent: Apr. 15, 2003

(54) MODULAR PLUG RECEPTACLES DEFINED BY MULTIPLE ELECTRONIC COMPONENTS

(75) Inventors: Tim Urry Price, West Valley, UT (US); David Oliphant, Salt Lake City, UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/935,856

(22) Filed: Aug. 23, 2001

(65) Prior Publication Data

US 2003/0040222 A1 Feb. 27, 2003

(51) Int. Cl.[7] ..... H01R 25/00; H01R 27/02
(52) U.S. Cl. ..... 439/638; 439/76.1; 439/946
(58) Field of Search ..... 439/638, 945, 439/946, 76.1

(56) References Cited

U.S. PATENT DOCUMENTS 5,155,663 A * 10/1992 Harase ..... 439/945
5,181,858 A * 1/1993 Matz et al. ..... 439/638
5,562,504 A * 10/1996 Moshayedi ..... 439/638
5,608,607 A * 3/1997 Dittmer ..... 439/946
5,619,396 A * 4/1997 Gee et al. ..... 361/686
5,773,332 A * 6/1998 Glad ..... 439/344
5,876,218 A * 3/1999 Liebenow et al. ..... 439/74
5,984,731 A * 11/1999 Laity ..... 439/676
6,174,205 B1 * 1/2001 Madsen et al. ..... 439/638
6,217,351 B1 * 4/2001 Fung et al. ..... 439/131
6,332,784 B1 * 12/2001 Oliphant et al. ..... 439/76.1
6,345,988 B1 * 2/2002 Ketcham ..... 439/946
6,394,844 B1 * 5/2002 Frias Valero et al. ..... 439/608

* cited by examiner

*Primary Examiner*—Khiem Nguyen
*Assistant Examiner*—Hae Moon Hyeon
(74) *Attorney, Agent, or Firm*—Workman, Nydegger & Seeley

(57) ABSTRACT

An integrated modular plug receptacle package is disclosed wherein one or more modular plug receptacles, or jacks, are defined by bringing two or more PC cards into operable communication, such as within the card slot cavity of a portable computer, for instance. Each PC card has formed on a posterior edge thereof one or more modular jack portions. The jack portions on one card coordinate with complimentary jack portions on the other card(s) to form an integrated modular jack to which may be connected a modular plug, such as an RJ series connector. In addition to PC cards, various electronic device components may have formed on a surface thereof modular jack portions enabling them to be operably connected to a similarly equipped component, thereby also defining a modular connector.

29 Claims, 6 Drawing Sheets

MODULAR PLUG RECEPTACLES DEFINED BY MULTIPLE ELECTRONIC COMPONENTS

BACKGROUND OF THE INVENTION

1. The Field of the Invention

The present invention generally relates to interfaces for electronic devices. More specifically, the present invention relates to the use of multiple electronic components to define one or more modular interface connectors for computers or other electronic devices.

2. The Relevant Technology

A. Introduction

Portable computers and other electronic equipment frequently use communications cards to allow electrical communication to be established between electronic devices or to allow electronic devices to be connected to communication systems. The communications cards are typically located internally within the computer or electronic equipment and the cards are relatively small in size. These communications cards, for example, are commonly used with modems, fax/modems, Local Area Network (LAN) adaptors and cellular telephone equipment.

Conventional communications cards are often constructed according to the Personal Computer Memory Card International Association (PCMCIA) guidelines, which set forth the physical specifications, or form factors, and electronic architecture of the cards (also known as PC cards). The PCMCIA guidelines define three types of cards and sockets, or slots, for support of electronic equipment. For instance, PCMCIA standards require all PC cards to have the same length and width (roughly the size of a credit card), and each card includes a connector to allow it to be connected to the computer or other host device. In particular, according to the known PCMCIA standards, PC cards have a length of 85.6 mm (3.4 inches), a width of 54.0 mm (2.1 inches), and a height of 3.3 mm (0.1 inches), 5.0 mm (0.2 inches) or 10.5 mm (0.4 inches) depending upon if the card is a Type I card, Type II card or Type III card, respectively. Type I PC cards are typically used for memory devices such as read only memory (ROM), flash memory or static random access memory (SRAM). Type II PC cards are generally used with input/output (I/O) devices such as data/fax modems, LANs and mass storage devices. Type III PC cards are used for devices whose components are thicker and require additional space, such as hard drives. The PCMCIA guidelines also define corresponding types of slots. Type I slots support only Type I cards, Type II slots support Type I and II cards, and Type III slots support all three types of cards.

A conventional PC card 10 is shown in FIG. 1. The PC card 10 has a generally rectangular shaped body with a top surface 12, a bottom surface 14, a right side 16, a left side 18, a front end 20 and a rear end 22. The terms "front" and "rear" are used in this application in reference to the direction in which the PC card 10 is inserted into the receiving socket. The front end 20 of the PC card 10 includes a 68-pin connector 24 that is used to connect the card to an electronic device such as a laptop portable computer. Disposed within the PC card 10 is a printed circuit board or substrate 26 with various electronic components 28 connected thereto that provide the necessary circuitry to perform the intended functions of the PC card.

B. Modular Connectors

Additionally, a variety of connectors has been developed in order to facilitate electrical communication between electronic devices and to allow electronic devices to be connected to communication systems. Conventional connectors typically include a plug and a corresponding jack that is sized and shaped to receive the plug. Thus, when the plug is inserted into the jack, the connector allows electrical communication to be established between the plug and the jack.

Conventional connectors are frequently constructed according to standards that are well known in the art to promote compatibility and interchangeability. These standard connectors allow various electronic devices and communication systems to be interconnected or linked as desired by the user. A conventional connector that is well known in the art is the RJ-xx series of modular connectors, such as the RJ-11, RJ-12 and RJ-45 connectors. The RJ series of connectors includes a modular plug and a corresponding modular jack that is sized and configured to receive the plug. The RJ-11 connector, for example, includes four or six contact pins and is commonly used to attach communication devices, such as telephones, facsimile machines and modems, to electronic devices. The RJ-45 connector includes eight contact pins and it is frequently used to connect LANs or Ethernets to electronic devices. The RJ series of connectors have the same overall configuration except for slightly different widths. Thus, the RJ-11 and RJ-45 connectors have the same general shape, but the RJ-45 connector is slightly wider than the RJ-11 connector.

As shown in FIGS. 2 and 3, a conventional RJ series connector 30, such as a RJ-11 modular connector, includes a jack 32 and a plug 34. The plug 34 includes a rectangular contact pin block 36 with a front end 38, a rear end 40, a top surface 42, a bottom surface 44 and a plurality of contacts 46 located proximate the front end of the block. The contacts 46 are recessed within tracks formed in the contact pin block 36, and the contacts are accessible from the front end 38 and bottom surface 44 of the block. A cable 48 is used to electrically connect the plug 34 to a communications system or other electronic device. The front end 38 of the contact pin block 36 typically includes a pair of notches that define front abutment surfaces 50 that are perpendicular to the top surface 42 of the block.

A biased retention clip 52 extends from the top surface 42 of the contact pin block 36. The biased clip 52 includes a broad base 54 in which the front end is integrally attached to the top surface 42 or front end 38 of the block 36, and the other end includes a narrow tab 56 extending away from the base 54. An abrupt transition between the base 54 and the tab 56 creates a pair of retention edges 58 on both sides of the tab 56. The biased clip 52 extends at an angle relative to the top surface 42 of the contact pin block 36 and the biased clip may be elastically deformed toward the top surface of the contact pin block to allow the plug 34 to be inserted and removed from the jack 32.

As best seen in FIG. 2, the jack 32 includes an aperture 60 that is sized and configured to receive the plug 34. The aperture 60 includes a first pair of notches 62 with a first opening 63 disposed between this first pair of notches, and a second pair of notches 64 with a second opening 65 disposed between this second pair of notches. When it is desired to insert the plug 34 into the jack 32, the user depresses the biased clip 52 toward the top surface 42 of the contact pin block 36, thus permitting the plug to be inserted into the receptacle. After the plug 34 is inserted into the jack 32, the user releases the biased clip 52 and, as shown in FIG. 3, the biased clip returns to its original position. The plug 34 is securely held within the jack 32 because the retention edges 58 of the biased clip 52 engage the inner surfaces of the second pair of notches 64 and the narrow tab 56 extends through the opening 65 formed between the second pair of notches.

Alternatively, instead of the user depressing the biased clip 52 toward the top surface 42 of the contact pin block 36, the user can simply insert the plug 34 into the aperture 60 and the base 54 of the biased clip 52 will engage the lower surfaces of the second pair of notches 64. This engagement of the base 54 with the lower surfaces of the second pair of notches 64 forces the biased clip 52 downwardly toward the upper surface 42 of the contact pin block 36, and this allows the plug 34 to be inserted into the jack 32. In either case, the plug 34 is securely held within the jack 32 and it cannot be removed by simply pulling on the plug or cable 48 in a direction away from the receptacle. Instead, the biased clip 52 must be depressed toward the upper surface 42 of the contact pin block 36 in order to remove the plug 34 from the receptacle 60.

C. PC Cards

As mentioned above, PC cards are highly utilized in electronic devices such as portable computer systems because they expand the capabilities of such devices. To take advantage of the capabilities offered by PC cards, most portable computers currently produced feature at least two slots suitable for electrically coupling PC cards to the portable computer. These card slots, located in a card slot cavity, are typically oriented in a stacked arrangement where one slot is disposed directly above another identical slot. Such card slot cavities can typically accommodate two type I or type II cards, or one type III card Because of their utility and versatility, a user of a portable computer may own several PC cards to assist the computer with a variety of tasks. As such, a user may desire to insert and use different PC cards at different times depending on the task at hand. For example, if the user desires more memory capacity for the computer, a RAM memory card may be inserted into one of the card slots of the portable computer. Or, if communication with a local area network (LAN) or other computer is desired, the user may insert a modem or network PC card. In the latter case, a modem or network PC card typically features a connector jack that accepts an RJ-11 or RJ-45 connector plug as described above, thus enabling on electrical connection to be made between the computer of the user and the remote computer or network. Unfortunately, given the large size of RJ series connectors, a user is often forced to do one of two things: either insert a type III modem or network PC card into one of the vertically stacked card slots of the portable computer, in order to accommodate the size of the RJ jack/plug configuration, or utilize a thinner type II PC card with an adapter cord that couples the RJ connector plug to the type II card.

Under the first option, a type III modem or network card inserted into one of the slots typically occupies, because of its greater thickness, substantially the same space that would be occupied by two type II cards located in the card slot cavity. This makes it impossible for a second PC card to be inserted into the adjacent slot. Therefore, if another PC card is desired to be inserted into the computer, it is first necessary to remove the Type III card, thus resulting in added inconvenience for the user.

If a thinner type H card is used under the second option, it is then possible to insert a second card into the free slot if desired. The user, however, is still encumbered by the adapter cord coupling the RJ connector to the first card. These adapter cords may be easily lost or inadvertently broken by a movement of the user or the portable computer. In any event, the adapter cord is an additional piece of computer hardware that must be cared for, thus increasing inconvenience for the user.

What is needed, therefore, is a PC card configuration that provides convenient modular jacks for placing electronic devices in mutual electrical communication. The configuration should be flexible, enabling cards to be exchanged and interchanged while preserving the functionality of the modular jacks. It should also be easily upgradeable, thus maximizing the economy and flexibility of the electronic device.

SUMMARY OF THE INVENTION

Given the existence of the above challenges in the current card technology, the present claimed invention provides a modular jack configuration, and a method of forming such a configuration, that is useful for interfacing electronic components. More specifically, the present invention forms a modular jack for use with a portable computer in a way that allows maximum utility of the computer's available expansion card slots.

The present invention also forms a modular jack out of interchangeable components, thus providing flexibility of use for both the jack and the components. The present invention further provides a uniform design to the interchangeable components forming the modular jack so that the components may be switched and substituted while still preserving the functionality of the jack. This would also serve to enhance the upgradability of such a configuration.

Briefly summarized, embodiments of the present claimed invention are directed to an integrated modular jack configuration where at least two electronic components are brought into operable proximity one with another such that each component defines a portion of a modular receptacle, or jack. It is noted that, as used herein, the term "electronic component" is understood to comprise a device or any of its constituent elements that separately, or in conjunction with other elements, operates at least partially according to principles governing electrical energy.

A preferred embodiment of the present invention forms an RJ series modular connector jack using two type II PCMCIA communications-type PC cards disposed in a stacked configuration within the card slot cavity of a portable computer such that each card forms a portion of the modular jack. Each PC card has defined on its rear edge a portion of the jack aperture. An upper card defines the upper jack portion corresponding to the upper portion of the RJ plug where the biased retention clip is disposed. A lower card defines the portion of the jack corresponding to the lower portion of the RJ plug where the connector pins are located. PC cards configured to be used in accordance with the present invention are preferably communication-type cards, e.g., modem and network cards, which permit interfacing between a portable computer and a remote computer, host system, or network. However, any type of PC card may be configured with a jack portion on its rear edge, thus enabling it to be used in conjunction with a similarly configured card to define a modular jack. In such a circumstance one of the PC cards would normally be of a communications type card, such as a modem card, while the other card could be a memory card or the like.

Though the modular jack is preferably formed so as to operably receive an RJ series plug, other jacks receiving other types of plugs may be defined on the PC cards instead. Also, one, two, or more connector jacks may be disposed on the edge of the PC card package. In a preferred embodiment, two RJ series jacks—one an RJ-11 jack, and the other an RJ-45 jack—are defined at the rear edges of the stacked PC cards inserted in the card slots of a portable computer. In this configuration, one of the RJ jacks has its connector pins disposed on the lower card and its retention clip receiving portion defined on the upper card. Correspondingly, the other RJ jack has its connector pins defined on the upper card while its retention clip receiving portion is located on the lower card. The card electronics necessary to support the communications function the particular jack is designed to perform are located in the card that has located on its edge the connector pins for that jack. In this way, a portable computer PC card is able to house all the electronics necessary for the particular communication task it is designed for (a modem or network card, for example) while the modular jack it uses to communicate with the remote electronic device is defined as a portion of the card itself as well as adjacently located cards.

A preferred embodiment of the present invention advantageously eliminates the need for special adapter cords to be used in conjunction with RJ plug-jack configurations. As such, RJ plugs are received into the modular jack of the present invention laterally creating a less intrusive design for portable computer users. The present invention also facilitates the functionality and form factor of a type III communications PC card but in an integrated dual type II card package. This in turn allows for the changeout of one of these modular jack portion-equipped cards for insertion of another PC card. Alternatively, if the newly inserted card is not of a type having the modular portions defined on its rear edge, then an adapter plug may inserted into the remaining modular jack portion-equipped communications card to enable an RJ plug to be connected to the card via the special adapter. In this way it is possible to use the interfacing functions of the communications card while still allowing other PC cards to be inserted into the adjacent slot when needed.

Moreover, it is possible to configure non-communications-type cards, e.g., memory cards and the like, to include in their rear edges corresponding jack portions. This will allow such cards to reside in the card slot cavity of a portable computer adjacent to a jack portion-equipped communications card and allow a full modular jack to be formed thereby. In this case, the non-communications card simply provides part of the physical structure of the modular jack used by the communications card that resides in an adjacent card slot.

Additionally, the features of the present invention allow for enhanced interchangeability of jack portion-equipped PC cards whereby new cards may be introduced into one slot of the portable computer without displacing the other jack portion-equipped card in the adjacent card slot, but still preserving the modular jack configuration between the two cards. This enhances the economy and cost savings possible with PC cards manufactured in accordance with the present invention.

Other advantages of the present invention include a compact configuration where the plug, jack, and card all fit within the card space allotted for in a standard portable computer having two stacked PC card slots. These features of the present invention will become more fully apparent from the following description and appended claims, or may be learned by the practice of the invention as set forth hereinafter.

BRIEF DESCRIPTION OF THE DRAWINGS

In order that the manner in which the above recited and other advantages and features of the invention are obtained, a more particular description of the invention briefly described above will be rendered by reference to specific embodiments thereof, which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 4:
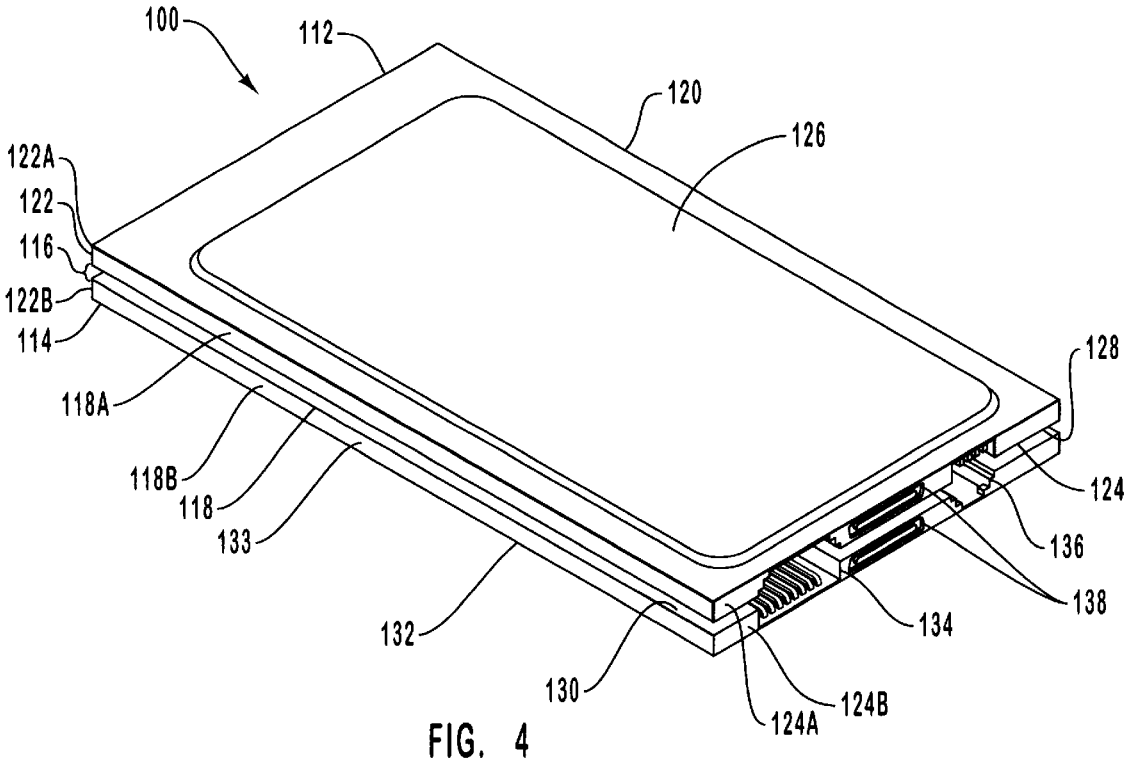
FIG. 4 is a perspective view of a communication PC card package in accordance with preferred embodiment of the present invention.

Further reference will now be made to the drawings, wherein exemplary embodiments of the present claimed invention are illustrated. Reference is first made to FIG. 4, which illustrates a perspective view of a preferred embodiment wherein two PCMCIA-compliant PC communications cards are configured in accordance with the present claimed invention to form an integrated modular jack card package denoted generally at 100. As mentioned above, terms such as "front," "rear," "top," "bottom," and the like are used in reference to the direction in which the PC card is inserted into the card slot of a portable computer. The card package 100 includes an upper communications card 112, a lower communications card 114, and a gap 116 between the two cards. The left faces 118A and 118B of the upper and lower communications cards 112 and 114, respectively, together comprise the left face 118 of package 100. Similarly, the right faces 120A and 120B of the upper and lower communications cards 112 and 114, respectively, together form the right face 120 of the package 100. A front edge 122A and a rear edge 124A of the upper communications card 112, together with a front edge 122B and a rear edge 124B of the lower communications card 114, respectively, form a front edge 122 and a rear edge 124 of the package 100. The upper card 112 includes a top face 126 and a bottom face 128, while the lower card 114 comprises a top face 130 and a bottom face 132. The left card face 118A, the right card face 120A, the front card edge 122A, the rear card edge 124A, the top card face 126, and the bottom card face 128 comprise the upper communications card housing 129. Similarly, the left card face 118B, the right card face 120B, the front card edge 122B, the rear card edge 124B, the top card face 130, and the bottom card face 132 comprise the lower communications card housing 133. Preferably, both the upper card housing 129 and the lower card housing 133 each define type II form factors according to PCMCIA standards. The gap 116 defines a plane extending parallel with the bottom face 128 of the upper card 112 and the top face 130 of the lower card 114.

A left modular jack 134, and a right modular jack 136, are disposed on the rear edge 124 of the card package 100. Further details about these jacks are found below. Additionally, self-contained plug receptacles 138 may be disposed on either or both rear edges 124A or 124B. The package 100 is designed to be removably inserted into a card slot cavity of a portable computer, as described below in further detail.

Figure 1:
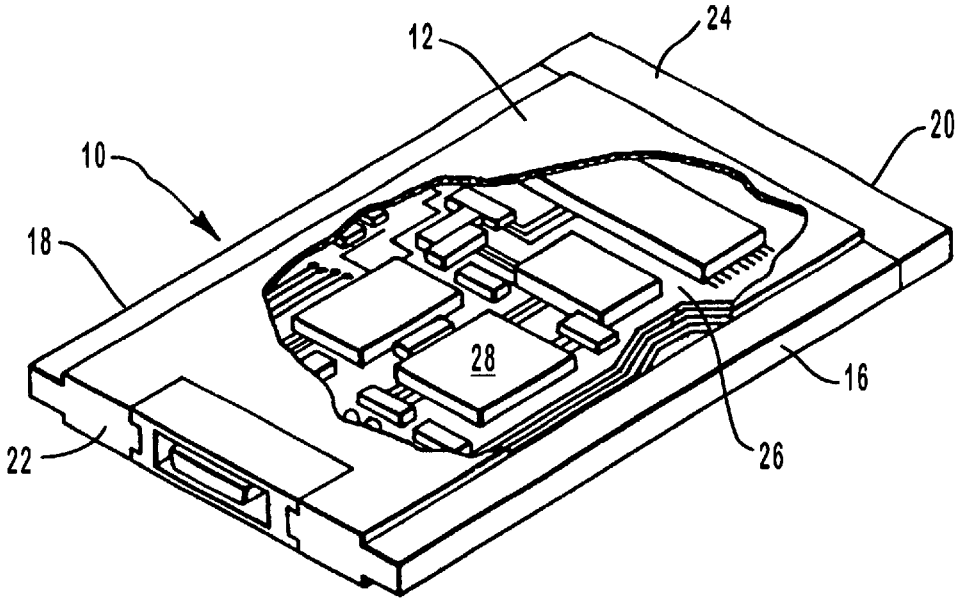
FIG. 1 (PRIOR ART)
FIG. 1 is a perspective view of a conventional communications card constructed in accordance with PCMCIA standards.
Figure 2:
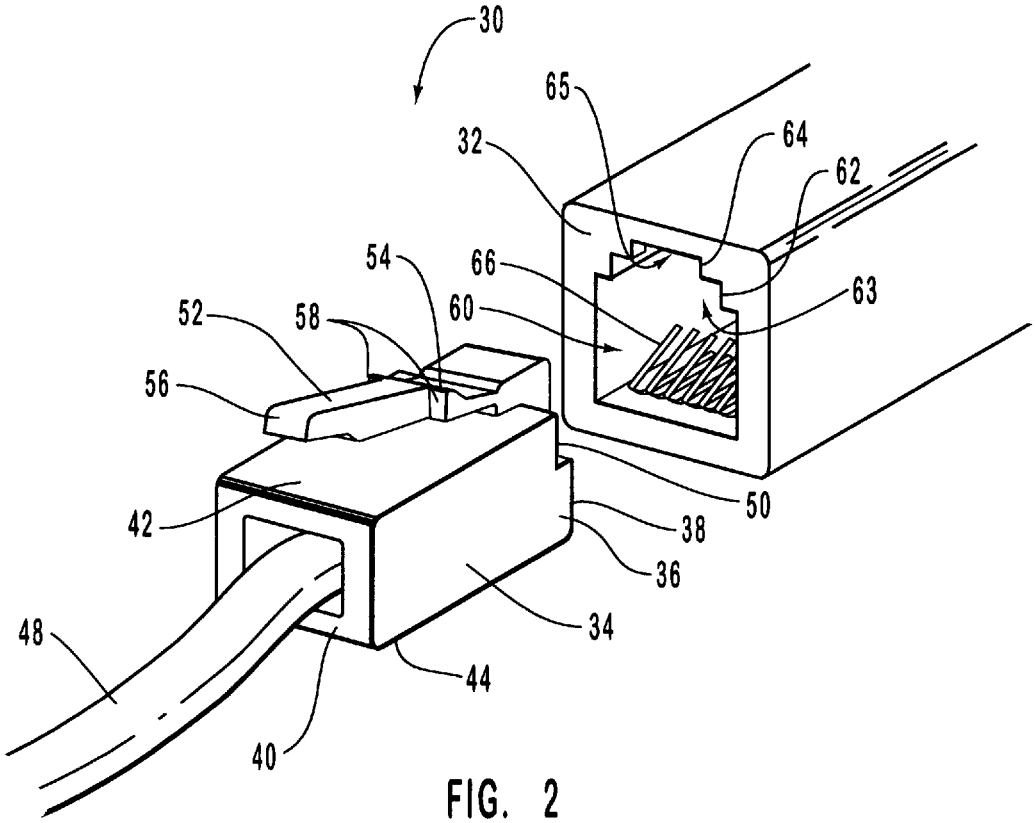
FIG. 2 (PRIOR ART)
FIG. 2 is a perspective view of a conventional RJ series connector, illustrating a connector plug and a corresponding receptacle.
Figure 3:
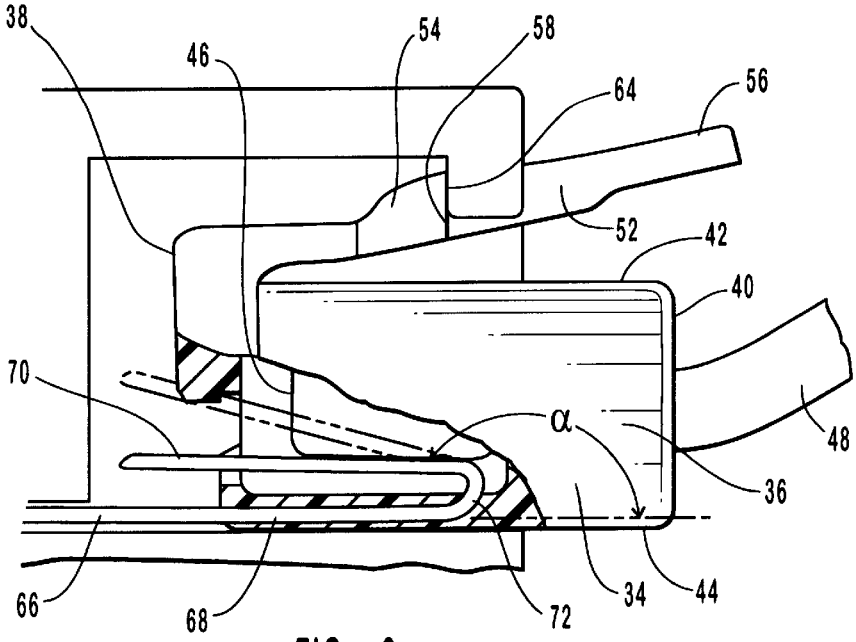
FIG. 3 (PRIOR ART)
FIG. 3 is a side view of a conventional RJ series connector shown in FIG. 2, with a portion of the connector plug and receptacle cut away, illustrating the plug inserted into the receptacle.
Figure 5A:
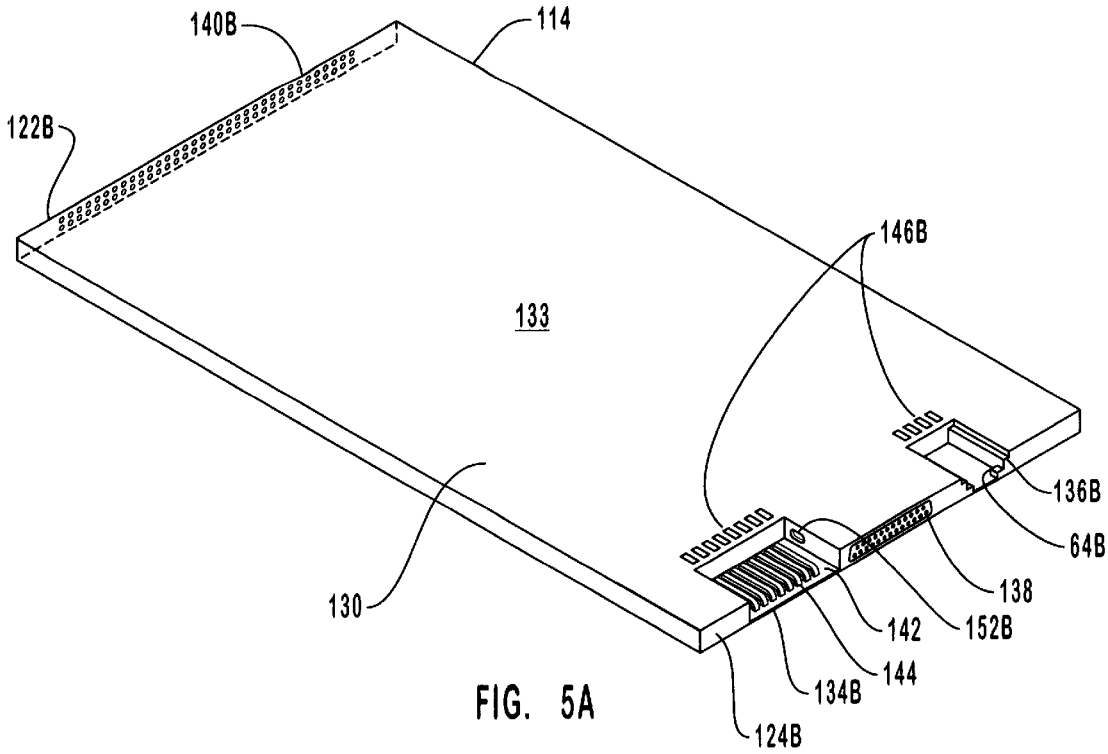
FIG. 5A is a perspective view of the lower card of the PC card package shown in FIG. 4, illustrating the bottom portions of the modular jacks formed therein.

Attention is now directed to FIG. 5A, where the lower card 114 of a preferred embodiment is illustrated in perspective view. A standard 68-hole electrical connector 140B, configured in accordance with PCMCIA standards is shown disposed on the front edge 122B. These holes receive corresponding pins (not shown) disposed in a card slot cavity found in an exemplary host system, such as a portable computer, thus forming an electrical connection between the computer and the lower communications card 114. A left modular jack portion 134B of the lower card 114 is shown disposed on the left side of the juncture of the top face 130 with the rear edge 124B of the lower card housing 133. The left modular jack portion 134B is shaped so as to matingly receive the lower portion of an RJ series plug 34 in the plug/jack arrangement described in the background section above. As such, the left modular jack portion 134B includes on its bottom interior surface 142 the contact pins 144 that electrically engage with a plurality of plug contacts disposed within corresponding tracks formed on the bottom face of the RJ plug 34 (see FIGS. 2 and 3). The contact pins 144 of the left modular jack portion 134B are in electrical communication with the interior electronics 28B disposed on the circuit board 26B (not shown) within the lower card 114 as described above. These electronics comprise the necessary circuitry to enable the lower card 114 to perform its intended communicatory functions, e.g., modem or network interfacing.

Similarly, a right modular jack portion 136B of the lower card 114 is disposed on the right side of the juncture of the top face 130 with the rear edge 124B of the lower card. The right modular jack portion 136B is shaped so as to matingly receive the upper portion of an RJ series plug 34 in the plug/jack arrangement described in the background section. In accordance with that arrangement, the right modular jack portion 136B enables the retention edges of the biased retention clip to releasably engage the inner surfaces of the second pair of notches 64B as described in the background section, thus securing the RJ plug 34 within the right modular jack 136 when both upper card 112 and the lower card 114 are disposed in the operable arrangement detailed below.

Disposed on the top face 130 of lower communications card 114, and located directly in front of both left and right modular jack portions 134B and 136B, are a plurality of intercard communication ports 146B. The communication ports 146B located on lower card 114 are configured to electrically engage with correspondingly located ports disposed on the bottom face of upper communications card 112. Such an arrangement allows for electrical communication between the two cards when the cards are disposed in the card slots of a portable computer for instance, in accordance with the present invention. Preferably, lower intercard communication ports 146B comprise a plurality of flat, electrically conductive contact plates arranged in linear fashion directly in front of both modular jack portions 134B and 136B. These ports are preferably comprised of a metallic or metallic alloy material, but any electrically conductive material would suffice. The specific manner in which the intercard communications port 146B electrically engage with the intercard communication ports 146A of the upper card 112 will be discussed below.

As discussed above, a self-contained plug receptacle 138 is preferably disposed on either the rear edge 124B or 124A of the communications cards, or on both rear edges. One of several receptacle configurations known in the art that are able to fit on the rear edge of one of the cards 112 or 114 could be disposed on either rear edge 124B or 124A. Alternatively, two plug receptacles 138 could be disposed on the rear edge of the card package 100, one on rear edge 124A, and the other on the rear edge 124B. An example of such a receptacle is an 11-pin data port receptacle known in the art.

Figure 5B:
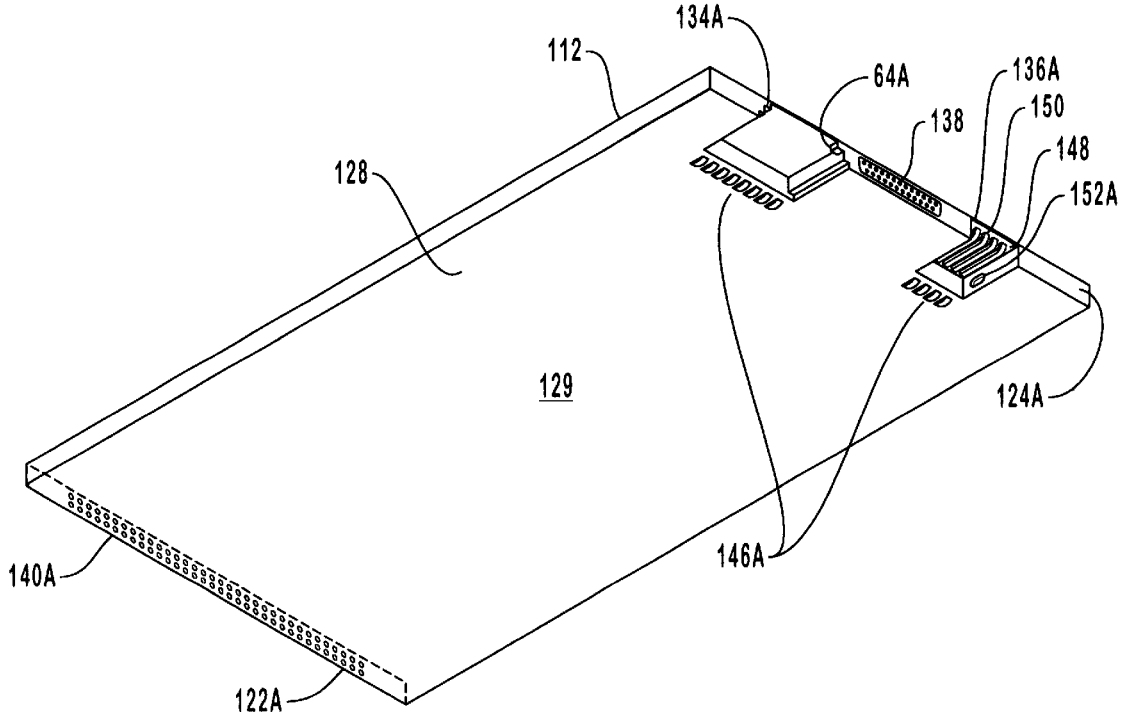
FIG. 5B is a perspective view of the upper card of the PC card package shown in FIG. 4, illustrating the top portions of the modular jacks formed therein.

Referring now to FIG. 5B, the features of the upper communications card 112 in a preferred embodiment are identical in many respects to the features of the lower communications card 114 outlined above. Upper card 112 has disposed on its front edge 122A a standard PCMCIA electrical connector 140A for electrical communication with host system, preferably a portable computer. A left modular jack portion 134A is disposed on the left side of the juncture of the bottom face 128 with the rear edge 124A of the upper card housing 129. The left modular jack portion 134A is shaped so as to matingly receive the upper portion of an RJ series plug 34 in the plug/jack arrangement described in the background section above. In accordance with that arrangement, the left modular jack portion 134A enables the retention edges of the biased retention clip to releasably engage the inner surfaces of the second pair of notches 64A as described in the background section, thus securing the RJ plug 34 within the left modular jack 134 when both the upper card 112 and the lower card 114 are disposed in the operable arrangement detailed below.

Similarly, a right modular jack portion 136A of the upper card 112 is disposed on the right side of the juncture of the bottom face 128 with the rear edge 124A of the upper card housing 129. The right modular jack portion 136A is shaped so as to matingly receive the lower portion of an RJ plug 34 in the plug/jack arrangement described in the background section above. As such, the right modular jack portion 136A includes on its top interior surface 148 the contact pins 150 that electrically engage with a plurality of plug contacts disposed within corresponding tracks formed on the bottom face of an RJ plug 34 (see FIGS. 2 and 3). The contact pins 150 of the right modular jack portion 136A are in electrical communication with the interior electronics 28A disposed on the circuit board 26A (not shown) within the upper card 112 as described above. These electronics comprise the necessary circuitry to enable the upper card 112 to perform its intended communicatory functions, e.g., modem or network interfacing.

Disposed on the bottom face 128 of upper communications card 112, and located directly in front of both left and right modular jack portions 134A and 136A, are a plurality of intercard communication ports 146A. These ports are configured to electrically engage with the correspondingly located communication ports 146B disposed on the top face 130 of lower card 114 when the two are brought into operable arrangement in accordance with the present invention, and as detailed below. Preferably, upper card intercard communication ports 146A comprise a plurality of electrically conductive nubs arranged in a linear fashion directly in front of both modular jack portions 134A and 136A. These ports are preferably comprised of a metallic or metallic alloy material, though again, any electrically conductive material would be sufficient.

Figure 6:
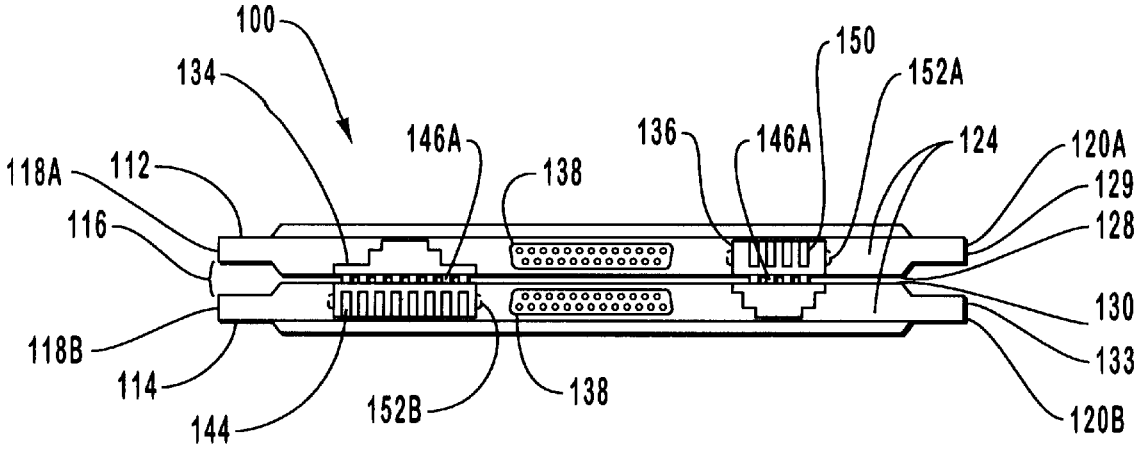
FIG. 6 is a front elevation view of the PC card package configuration shown in FIG. 4.

Reference is now made to FIG. 6, where a front view of the upper and lower communications cards 112 and 114 of a preferred embodiment are shown in operable communication, such as when the two cards 112 and 114 are disposed in respective slots within the card slot cavity of a portable computer. This figure depicts the shapes of left and right modular jacks 134 and 136. In a preferred embodiment the left modular jack 134 is configured to operably receive an RJ-45 plug, typically used in network-type communication PC cards. The right modular jack 136 is preferably configured to operably receive an RJ-11 plug, typical of those employed to connect to modem PC cards. Accordingly, a preferred embodiment of the card package 100 disposes the electronics 28B (not shown) that are necessary for the functioning of a network communications PC card inside the housing 133 of the lower card 114. Likewise, the electronics 28A (not shown) necessary for the functioning of a modem communications PC card are disposed inside the housing 129 of the upper card 112. The jack contact pins 144 of left modular jack 134 are in electrical communication with the network communications electronics 28B disposed in the lower card 114. And the jack contact pins 150 of right modular jack 136 are in electrical communication with the modem communications electronics 28A disposed in the upper card 112. When an RJ-45 plug 34 is inserted into left modular jack 134, then, an electrical connection is formed between the portable computer and lower card 114 via the electrical connector 140B (see FIG. 5A). This electrical connection continues from the lower card 114 and into the plug 34 through the jack contact pins 150, and on to a remote network-based host system. A similar electrical connection is established between a portable computer and a modem-based remote host system via the right modular jack 136 of upper communication card 112 and an RJ-11 plug connected thereto.

It will be appreciated by one of skill in the art that, in contrast to the preferred embodiment, both left modular jack 134 and right modular jack 136 may comprise identical connectors. For instance, both may accommodate an RJ-11 plug as used with modem cards. Or alternatively both modular jacks 134 and 136 may be configured to receive RJ-45 plugs therein. Such arrangements are accordingly contemplated as being within the scope of the present claimed invention.

The left and right modular jacks 134 and 136 are preferably positioned on the rear edge 124 such that they are mutually equidistant from a hypothetical line perpendicular to the plane defining the gap 116 and bisecting the rear edge 124 of the card package 100. Of course, the placement of the left and right modular jacks could be varied to include several positioning combinations across the rear edge of the card package 100, and such alternative placements would reside within the scope of the present invention. Additionally, it is understood that one, two, or more modular jacks could conceivably be disposed on the rear edge 124 of the package 100 if desired, provided the upper and lower cards 112 and 114 are fitted with the necessary electronic components 28A and 28B sufficient to support the functionality of each modular jack.

It will be appreciated that, although a preferred embodiment disposes modular jacks having an RJ series-type plug interface on the card package edge, various other connector types could be used instead. Examples of such other connector types include but are not limited to mini-DIN, D-sub, and USB (Universal Serial Bus) connectors. Accordingly, such other connector arrangements are contemplated as being within the scope of the present claimed invention. Furthermore, it is understood that more than two communications cards could be employed to perform the same functionality as disclosed herein. For instance, if desired, three PC cards could be disposed in a stacked arrangement with a modular jack defined on a portion of each of the rear edges of the three PC cards. Or a modular jack could be configured on the rear edge of two of the three cards while a second modular jack is disposed on a different pair of the three cards. Such alternative structures, therefore, are contemplated as falling within the claims of the present invention.

With continuing reference to FIG. 6, the gap 116, running parallel to and existing between both bottom face 128 of upper card 112 and top face 130 of lower card 114, is depicted. This gap 116 results from current card mounting configurations within PC card slot cavities found in most portable computers. In a typical PC card slot cavity configured to allow two PC cards to reside within it in a stacked configuration, each PC card is slidably received between support brackets mounted within the slot cavity. Given the normal thickness of such brackets, two inserted PC cards will have existing between them a small gap, represented at 116 in FIG. 6, while the cards are residing within the card cavity slot. This gap 116 is accounted for in that the dimensions of the left and right modular jacks 134 and 136 are sized and configured so that a plug 34 slidingly fits therein and electrical communication between the plug and the jack is established. At the same time, it is appreciated that the present invention contemplates adequate functionality of left and right modular jacks 134 and 136 when no gap 116 exists, or when a larger gap than is depicted in FIG. 6 exists between the upper and lower cards 112 and 114. Of course, minor modifications to the left and right modular jacks 134 and 136, and to intercard communication ports 146, would be made to preserve the functionality of the present invention.

It is further appreciated that the orientation of either left modular jack 134 or right modular jack 136 could be rotated 180 degrees about an axis perpendicular to the face of the rear edge 124 of the package 100 such that both modular jacks are oriented identically, i.e., that the jack contact pins 144 and 150 are both disposed on the same communications card. Such an orientation of the modular jacks may be desirable in connection with one of the alternative embodiments outlined in further detail below.

As discussed above, intercard communication ports 146A and 146B facilitate electrical communication between upper and lower communications cards 112 and 114 as may be needed for the proper operation of either card's communicatory function. FIG. 6 demonstrates how intercard communication ports 146A and 146B operably interconnect so as to facilitate the electrical communication between upper and lower communications cards 112 and 114 when the cards are in operable communication one with another. As can be seen from FIG. 6, the intercard communication nubs 146A downwardly extend from the bottom face 128 of upper card 112 across the gap 116, and contact the intercard communication plates 146B disposed on the top face 130 of lower card 114. Electrical communication between the cards is thus established. Upper and lower cards 112 and 114 are preferably equipped with the necessary interior electronic components 28A and 28B (not shown), respectively, so as to enable the intercard communication.

It is appreciated that other connection configurations could be employed to provide intercard communication. An example of alternative configurations would include nubs disposed on both the upper card 112 and the lower card 114 such that the nubs on each card physically contact in a mutual fashion when the two cards are placed within the card slot cavity of a portable computer. Another exemplary configuration would include detents arranged on one face of a card, and spring-like contact wires that would engage the detents when the cards are brought together in operable arrangement. Accordingly, such other devices and structures are contemplated as being within the scope of the present claimed invention.

Referring again to FIG. 6, locking detents 152A and 152B are disposed on the interior side walls of right modular jack portion 136A and left modular jack portion 134B, respectively. These detents receive locking clips mounted on either side of the body of a plug adapter 154 (see FIG. 8) so as to facilitate the adapter to releasably engage a portion of the modular jack when a non-compliant PC card has been inserted in place of either upper or lower card 112 or 114, as will be described in further detail below.

Figure 7:
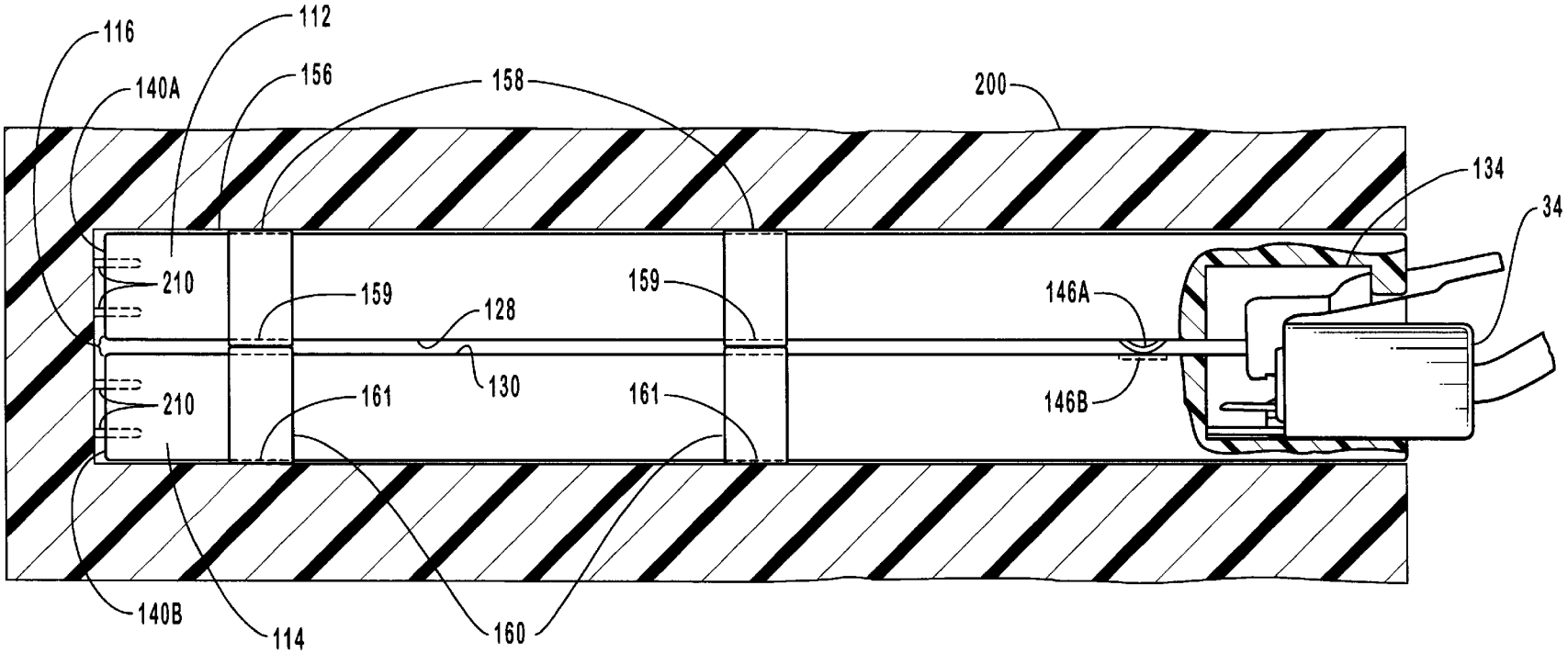
FIG. 7 is a cross sectional/side view of the PC card package shown in FIG. 4, illustrating an RJ series plug inserted in the modular jack formed by the card package configuration.

Reference is now made to FIG. 7, where a cross-sectional/side view of a preferred embodiment of the present invention is depicted. As can be seen, upper communications card 112 and lower communications card 114 are inserted within the card slot cavity 156 of a typical portable computer 200. Upper and lower PCMCIA standard 68-hole electrical connectors 140A and 140B are shown receiving corresponding electrical connector pins 210 emerging from the interior end of the card slot cavity 156 of the portable computer. One or more upper support brackets 158 and one or more lower support brackets 160 are each disposed in an opposing fashion on either interior side of the card slot cavity 156. The upper and lower cards 112 and 114 are slidingly received by the upper and lower support brackets 158 and 160, respectively, upon insertion of the cards into the card slot cavity 156, and are held in place by the brackets after the electrical connector pins 210 at the interior end of the cavity are fully seated within the electrical connector holes 140A and 140B. Each upper support bracket 158, and each lower support bracket 160, has a short lateral member 159 and 161 that supports the respective card 112 or 114 on the bottom face of each card. The nature of the support given by the short lateral members 159 and 161 introduces the gap 116 spoken of earlier that is present between the bottom face 128 of upper card 112 and the top face 130 of lower card 114.

The RJ plug 34 is shown in FIG. 7 inserted into left modular jack 134 in accordance with the present invention. This plug/jack connection occurs in the same manner as described in the background section, thus connecting a portable computer to a remote host system via upper and lower communications card 112 and 114. Note that a preferred integrated modular jack package 100, comprising two type II communications PC cards in an operable configuration with the cards having one or two RJ plugs 34 inserted into one or both of the modular jacks 134 and/or 136, substantially occupies the space typically occupied by a standard type III form factor PC card. One of the advantages of the present invention, is a significantly efficient use of the limited available space in a typical portable computer card slot configuration. The present invention maximizes the use of such space to compactly provide two independently operable communications cards and a plug/jack configuration for electrical connection thereto.

FIG. 7 also shows the preferred configuration for facilitating electrical intercard communication. The nubs 146A are shown downwardly extending from the top face 130 of lower card 114 and are contacted by the nubs when the cards are brought into operable communication.

It will be appreciated that, as an alternative to the type II PC cards illustrated and discussed in the preferred embodiment, other PCMCIA form factors could be utilized in providing an integrated modular jack card package. For example, type I or even type m PC cards could conceivably be employed to provide the same functionality as is disclosed herein. Further, cards conforming to form factors other than those of the PCMCIA standard are also understood to reside within the present invention as will be apparent to those of skill in the art. An example of such a card would include compact flash cards and the like that possess a different form factor than PCMCIA cards, but could still provide the functionality of standard PCMCIA cards as disclosed in the preferred embodiment.

The above discussion discloses a preferred embodiment of the present invention, utilizing PC cards to form an integrated modular jack card package for use with a portable computer. It is contemplated, however, that other electronic devices utilizing similar electronic cards may also benefit from the present invention. Examples of such other devices include desktop computers, personal digital assistants (PDA's), cellular phones, digital cameras, etc. Accordingly, the formation of modular jacks utilizing PC or other cards for use in a variety of electronic and other devices is contemplated as residing within the claims of the present invention.

It is also contemplated that the electronic components brought into operable communication to form one or more modular jacks need not comprise PC or other types of cards, but rather can comprise various other components upon which such a modular jack could be formed. For example, an exterior portion of a cellular phone housing could be operably coupled with a portion of its attachable battery pack, each portion having formed therein a modular jack portion similar to those formed in communications cards as described above and as depicted in the accompanying drawings. Assuming that either the phone or battery pack contained the necessary electronics, the modular jack could be employed to accept a wireless data plug or the like. Accordingly, it is understood that the bringing of two or more electronic or electronic-related components into proximity one with another such that they form one or more modular jacks for receiving modular plugs therein, is contemplated as residing within the claims of the present invention.

An alternative embodiment of the present invention is disclosed wherein the upper communications card 112 contains no electronic components 28A. The card is nonetheless inserted as a "dummy" card into the upper slot within a card slot cavity of a portable computer. This upper dummy card 112 is also equipped with the upper left and right modular jack portions 134A and 136A so that it forms, in conjunction with the lower left and right modular jack portions 134B and 136B (when the lower card 114 is also in place within the card slot cavity) the left and right modular jacks 134 and 136. The purpose of the upper dummy card 112 is to provide the structure necessary to complete the modular jacks 134 and 136. Lower card 114, as in the preferred embodiment, is equipped with the necessary interior electronic components to enable its communicatory function as, for example, network communications with a remote host system. Thus, in this alternative embodiment, the left modular jack 134 is the only "active" modular jack of the two jacks, because the jack contact pins 144 that electrically connect the lower card's electronic components are disposed in the left modular portion 134B (see FIG. 6). Of course, it would be possible to omit the right modular jack portion 136B from upper dummy card 112 in order to avoid user confusion as to which modular jack is active. Also, the use of a dummy card 114 to take the place of the lower communications card 114 instead of the upper card as described above, is possible. In this case, upper card 112 would be an active communications card, such as a modem card. The right modular jack 136, having its jack contact pins 150 connected to the interior electronic components of upper card 112, would be active. Lower dummy card 114 would still contain left and right modular jack portions 134B and 136B, but the left modular jack 134 would be inactive.

In another alternative embodiment, cards designed for purposes other than communication functions are employed in the integrated modular jack card package 100. In accordance with this embodiment the upper card 112 of the present invention is no longer a communications card (a modem or network card, for example), but is a card serving some other function for the portable computer, such as a memory card to expand computer RAM. In accordance with the present invention, it is appreciated that such a non-communications-type card could be configured to include on its rear edge 124A a left modular jack portion 134A such that a complete and active left modular jack 134, comprising the left modular jack portion 134A from the upper non-communications card 112 and the left modular jack portion 134B from lower communications card 114, is formed between the upper and lower cards when both are inserted in a stacked arrangement within the card slot cavity of a portable computer. Of course, this alternative embodiment functions equally well if the lower card 114 is chosen to be a non-communications-type card while upper card 112 remains a communications card. In this case, the non-communications lower card 114 has defined on its rear edge 124B the right jack portion 136B that cooperatively forms, with the right modular jack 136A on upper communications card 112, an active right modular jack 136 when the two cards are disposed in a stacked arrangement within the card slot cavity of a portable computer. The purpose of this alternative embodiment is to enhance the versatility of the modular jack card package 100. For example, if a user desires more RAM for a portable computer currently housing two communications cards of the preferred embodiment of the modular jack card package 100, the user may easily remove the upper communications card 112 (a modem card in this example) and replace it with a memory card configured in accordance with the alternative embodiment. Because the new upper non-communications-type memory card 112 is equipped with the left modular jack portion 134A, it cooperatively forms, with the left modular jack 134B of the lower card 114, the left modular jack 134. This enables left modular jack 134 to receive an RJ plug 34, and allows lower card 114 to utilize the jack/plug connection to connect the portable computer to a remote host system. In this way, the communications card that remains in the card slot cavity (lower card 114 in this example) is operably unaffected by a changeout of the other communications card of the preferred embodiment. Such a functional independence between the PC cards is an advantage over the prior art. Indeed, virtually any combination of communication and non-communication PC cards could be created using this embodiment.

In summary, therefore, preferred and alternative embodiments of the present invention show that the integrated modular jack card package 100 may comprise a variety of card types including but not limited to communications cards (PCMCIA and others), non-communications-type cards (PCMCIA and others), as well as dummy cards.

Figure 8:
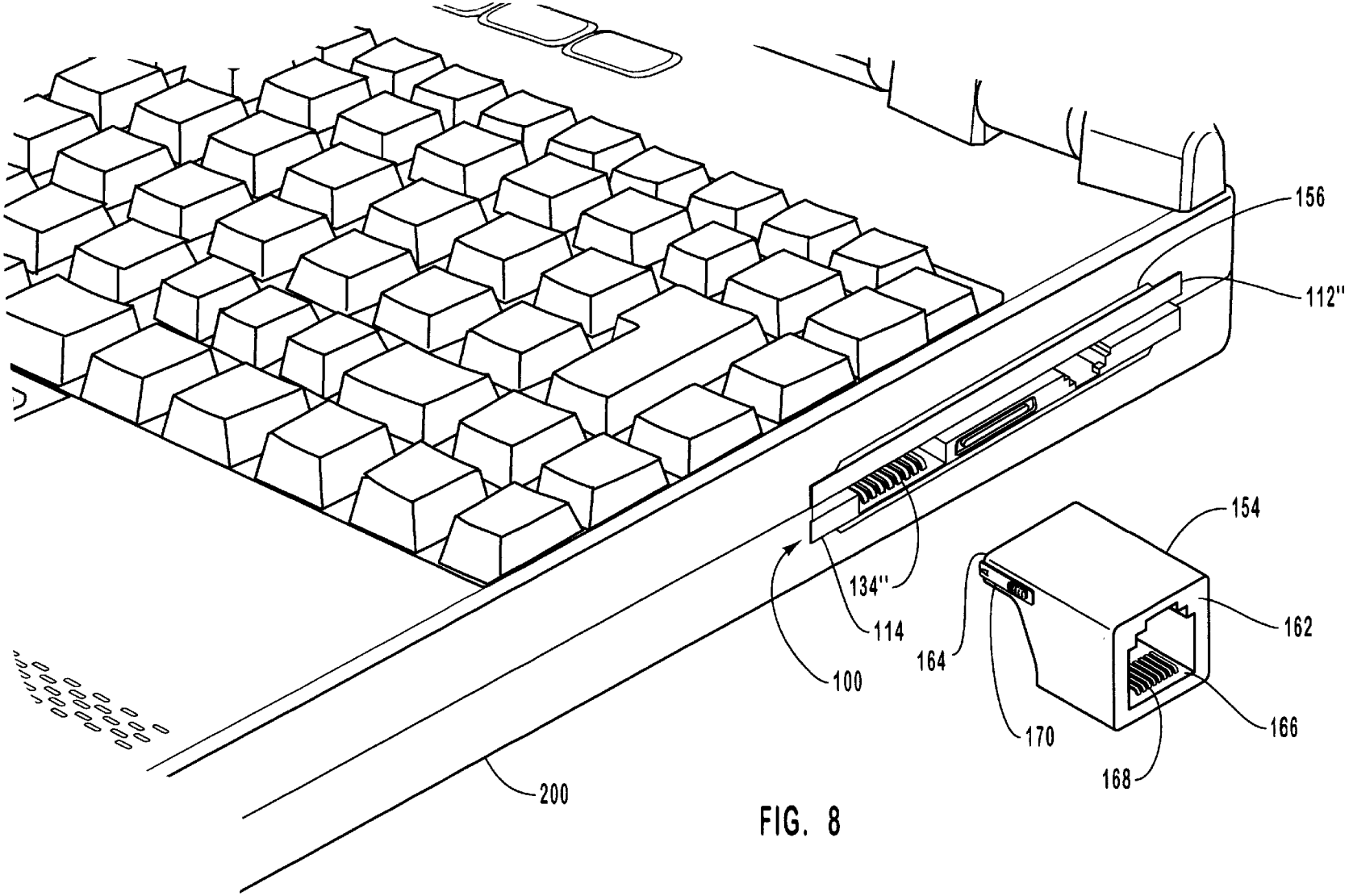
FIG. 8 is a perspective view of a portable computer having inserted therein half of the PC card package together with a standard PC card, and illustrating a plug adapter useful for connecting an RJ series plug to a partially formed RJ series jack.

Referring now to FIG. 8, another alternative embodiment of the present invention is disclosed wherein a PC card not having modular jack portions on its rear edge replaces one of the upper or lower communications cards of the preferred embodiment within the card slot cavity 156 of a portable computer 200. This PC card may be one of a variety of PC cards currently available for use with portable computers. Such cards may be accommodated by the present invention in the following manner. A preferred modular jack card package 100 disposed in the card slot cavity of a typical portable computer initially comprises an upper communications card 112 capable of modem functionality, and a lower communications card 114 capable of network communication with a remote host system. The upper communications card 112 is then removed by a user and in its place is inserted within the card slot cavity a typical prior art PC card 112, such as a RAM memory card. Obviously, the upper modem card 112 that was removed from the package 100 is now not functional. The lower network card 114, however, retains its functionality even though only half of its corresponding left modular jack 134 is present in the package 100 now that the prior art PC card 112 has been inserted. Connection of a modular plug to this half modular jack 134 is made possible through the use of a modular plug adapter 154. The modular plug adapter 154 allows a standard modular plug, such as an RJ series plug, to be inserted in the half modular jack 134. The modular plug adapter 154 comprises a modular plug receiving end 162 and a modular jack insertion end 164. The plug receiving end 162 comprises a modular jack 166 shaped identically to left and right modular jacks 134 and 136 of upper and lower communications cards 112 and 114 of the preferred embodiment. The modular plug adapter 154 also comprises jack contact pins 168 that extend within the modular plug adapter 154 from the modular plug receiving end 162 to the modular jack insertion end 164. The modular jack insertion end 164 is shaped so as to be releasably inserted within the half modular jack 134. Locking clips 170 are mounted on either side of the body of the modular plug adapter 154 so as to be received by locking detents 152A (see FIG. 5*a*) that are disposed on the interior side walls of half modular jack 134 and to lock the adapter in an inserted position within the half modular jack. When the modular plug adapter 154 is fully inserted, and when a modular plug 34 is received by the modular plug receiving end 162 of the plug adapter, electrical communication is established between the modular plug and the lower communications card 114 via the plug adapter. In this way, the functionality of the lower communications card 114 is preserved, even when a typical PC card is inserted in a position normally occupied by an upper communications card 112 configured in accordance with the present invention. When it is desired to remove the modular plug adapter 154, the user grasps gripping portions located on either locking clip 170, presses inward to disengage the locking clips from the locking detents 152A, and pulls the adapter out of the half modular jack 134 while maintaining finger pressure on the locking clips.

Of course, the functionality of an upper communications card 112 would be preserved if the lower communications card 114 were removed in favor of inserting a typical prior art PC card. In this case, the upper card 112 would be treated in an identical fashion to lower communications card 114 as discussed above.

As with other alternative embodiments, this embodiment advantageously increases the efficiency with which a user may operate a portable computer, thus enhancing the computer's versatility. In its preferred embodiment, a user has full use of a modem communications card, a network communications card, or both. Should a user desire to utilize another PC card that does not correspond to the modular jack card package described herein, either of the two communications cards may be replaced by the non-compliant PC card, which now is fully usable by the computer. The communication card that remains is also still functional with the assistance of the appropriate plug adapter.

In summary, the present invention features several advantages over the prior art. In the preferred embodiment a primary advantage is the ability to interchange both jack-equipped and non-jack-equipped PC cards in the card slot cavity of a portable computer without affecting the operability of adjacently disposed jack-equipped cards. This feature enhances the card swapping capabilities of a computer user, which in turn increases the versatility and operating economy of the computer, especially when various PC cards are needed by the computer at different times. Also, the modular jack card package of the present invention enables connector plugs to be laterally inserted into the modular jacks formed thereby, thus increasing user convenience. Finally, the space requirements of the present invention are modest, providing two PC cards and at least two plugs and jacks residing within the interior space of the card slot cavity of a computer. This serves to save increasingly valuable space in today's age of shrinking electronic devices.

The present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. A modular plug receptacle package comprising:

a first electronic component that is capable of being operably interfaced with a host system via a first host interface;

at least one other electronic component that is capable of being operably interfaced with a host via a second host interface;

a connector portion disposed on each electronic component such that the connector portions together form a modular receptacle when the electronic components are both operably interfaced with the host system.

2. A modular plug receptacle package as defined in claim 1, wherein the electronic components comprise PC cards for use with a host system.

3. A modular plug receptacle package as defined in claim 1, wherein the at least one modular receptacle comprises at least one RJ series modular jack.

4. A modular plug receptacle package as defined in claim 1, wherein two modular receptacles are defined on the electronic components.

5. A modular connector package comprising:

a first card capable of being operably received within a slot of a host system;

a second card capable of being operably received within a slot of the host system;

a first connector portion formed along an edge of the first card; and a second connector portion formed along an edge of the second card such that when the first card and the second card are received within slots of the host system, the first and the second connector portions together form a modular receptacle capable of receiving a modular plug.

6. A modular connector package as defined in claim 5, wherein the first connector portion and the second connector portion together form the modular receptacle capable of receiving an RJ series plug.

7. An integrated modular plug receptacle PC card package for use with electronic devices, the package comprising:

an upper card and a lower card, each card having a top cover portion, a bottom cover portion, an upstanding first side, an upstanding second side, a front edge and a back edge; and at least one modular receptacle portion defined on the back edge of both the upper and the lower card, said modular receptacle portions sized and configured such that when the upper card is operably connected to a slot within a host system adjacent and above the lower card that is also operably connected to a slot within the host system, the modular receptacle portions together define at least one modular receptacle for receiving a modular plug.

8. An integrated modular plug receptacle PC card package as defined in claim 7, wherein the host system comprises a portable computer.

9. An integrated modular plug receptacle PC card package as defined in claim 8, wherein at least either the upper card or lower card comprises a communications-type PC card for use in the portable computer.

10. An integrated modular plug receptacle PC card package as defined in claim 9, wherein at least either the upper card or lower card comprises a PC card of the PCMCIA type.

11. An integrated modular plug receptacle PC card package as defined in claim 10, wherein the at least one modular receptacle is sized and configured to receive an RJ series plug.

12. An integrated modular plug receptacle PC card package as defined in claim 11, wherein two modular receptacles are defined by the apertures.

13. An integrated modular plug receptacle PC card package as defined in claim 12, wherein each modular receptacle further comprises a plurality of contact pins disposed on an interior surface of the receptacle.

14. An integrated modular plug receptacle PC card package as defined in claim 13, wherein one modular receptacle is disposed on the package such that its contact pins are in electrical communication with the upper card, and the other modular receptacle is disposed such that its contact pins are in electrical communication with the lower card.

15. An integrated modular plug receptacle PC card package as defined in claim 14, further comprising at least one plug receptacle that is completely disposed on the back edge of either the upper card or the lower card.

16. A modular connector package comprising:

a first card having at least one connector portion defined along an edge thereof, the first card capable of being operably received within a slot of a host system;

a second card having at least one connector portion defined along an edge thereof, the second card capable of being operably received within a slot of the host system; and means for physically and simultaneously coupling a modular connector plug to both the first card and the second card when both the first and second cards are received within the slots of the host system and the connector portions together form at least one modular receptacle capable of receiving the modular plug system.

17. A modular connector package as defined in claim 16, further comprising means for establishing electrical communication between the first card and the second card.

18. A modular connector package as defined in claim 17, wherein the first card and the second card each further comprise a top cover portion, a bottom cover portion, an upstanding first side, an upstanding second side, a front edge and a back edge.

19. A modular connector package as defined in claim 18, wherein the means for establishing electrical communication between the first card and the second card comprises a plurality of raised surfaces downwardly extending from the bottom cover portion of the first card, the plurality of raised surfaces contacting electrically conductive portions disposed on the top cover portion of the second card.

20. A method for forming a modular connector comprising the steps of:

defining a first connector portion along an edge of a first PC card;

defining a second connector portion along an edge of a second PC card; and disposing the first and second PC cards such that the first and second connector portions together define a modular connector jack suitable for receiving a modular connector plug.

21. A method for forming a modular connector as defined in claim 20, further comprising the steps of:

electrically connecting the first PC card to a slot in an electronic device;

electrically connecting the second PC card to a slot in an electronic device.

22. A method for forming a modular connector as defined in claim 20, wherein the disposing the first and second PC cards step further comprises the step of:

disposing the first and second PC cards such that the first card resides adjacent to and directly above the second PC card.

23. A modular connector package, comprising:

a first communications card having first and second upper connector portions defined on an outer edge of the first communications card; and a second communications card having first and second lower connector portions defined on an outer edge of the second communications card, wherein the first lower connector portion together with the first upper connector portion forms a first modular receptacle capable of receiving a modular plug and the second lower connector portion together with the second upper connector portion forms a second modular receptacle capable of receiving a modular plug when the first and second communications cards are received within slots of a host system.

24. A modular connector package, comprising:

a first communications card;

a second communications card;

first and second upper connector portions located on the first communications card; and first and second lower connector portions located on the second communications card, wherein the first lower connector portion forms a first modular receptacle together with the first upper connector portion and wherein the second lower connector portion forms a second modular receptacle together with the second upper connector portion when the first and second communications cards are received within adjacent slots of a host system.

25. A modular connector package as defined in claim 24, wherein the first and second modular receptacles are formed on an outer edge of the first and second communications cards.

26. A modular connector package as defined in claim 25, wherein the second upper connector portion includes contact pins for electrically connecting a modular plug to the first communications card, and wherein the first lower connector portion includes contact pins for electrically connecting a modular plug to the second communications card.

27. A modular connector package as defined in claim 26, further comprising a plurality of conductive nubs disposed on the first communications card, the conductive nubs configured to electrically connect with a plurality of conductive contact plates located on the second communications card.

28. A modular connector package as defined in claim 27, wherein the first modular receptacle defines an RJ-11 jack, and wherein the second modular receptacle defines an RJ-45 jack.

29. A modular connector package as defined in claim 28, wherein at least one of the first and second communications cards further includes a complete receptacle for receiving a plug.

* * * * *

UNITED STATES PATENT AND TRADEMARK OFFICE

CERTIFICATE OF CORRECTION

PATENT NO. : 6,547,602 B2
DATED : April 15, 2003
INVENTOR(S) : Tim Urry Price and David Oliphant It is certified that error appears in the above-identified patent and that said Letters Patent is hereby corrected as shown below:

Column 3,
Line 26, after "type III card" insert a period
Line 26, before "Because" start a new paragraph
Line 38, after "enabling" change "on" to -- an --
Line 57, after "type" change "H" to -- II --

Column 5,
Line 26, before "inserted" insert -- be --

Column 12,
Line 14, after "type" change "m" to -- III --

Column 15,
Line 53, before "via" insert -- system --

Column 17,
Lines 10-11, after "plug" delete "system"

Signed and Sealed this

Second Day of September, 2003

JAMES E. ROGAN
*Director of the United States Patent and Trademark Office*